US005676454A

United States Patent [19]

De'Armond, Jr.

[11] Patent Number: 5,676,454

[45] Date of Patent: Oct. 14, 1997

[54] AIMING DEVICE FOR TRACK LIGHTING

[75] Inventor: Robert E. De'Armond, Jr., Celina, Ohio

[73] Assignee: W.A.C. Lighting Co., College Point, N.Y.

[21] Appl. No.: 644,542

[22] Filed: May 10, 1996

[51] Int. Cl.[6] ..... F21V 21/28

[52] U.S. Cl. ..... 362/275; 362/287; 362/419; 362/427

[58] Field of Search ..... 362/275, 287, 362/288, 404, 418, 417, 427; 248/278.1

[56] References Cited

U.S. PATENT DOCUMENTS

| | | | |
|---|---|---|---|
| 1,592,925 | 7/1926 | Webb | 248/278.1 |
| 1,858,232 | 5/1932 | Piombo . | |
| 3,543,017 | 11/1970 | Mihailoff | 240/4 |
| 4,727,460 | 2/1988 | Payne | 362/269 |
| 4,814,955 | 3/1989 | Price | 362/275 |
| 4,931,917 | 6/1990 | Scherf | 362/371 |
| 5,049,081 | 9/1991 | Ribitsch | 439/10 |
| 5,325,281 | 6/1994 | Harwood | 362/271 |
| 5,450,303 | 9/1995 | Markiewicz et al. | 362/419 |

*Primary Examiner*—Stephen F. Husar
*Assistant Examiner*—Sara Sachie Raab
*Attorney, Agent, or Firm*—Robert W. J. Usher

[57] ABSTRACT

An aiming device for track lighting includes an elbow member rotatively mounting a lamp housing to a vertical extension tube. The elbow member has an upper end connected to a lower end of the extension tube for rotation in a horizontal plane through 355 and a lower, transverse end formed with an annulus of locking teeth and an internal rotation limiting rib. The lamp housing has a lateral mounting plate with a connecting turret with a rim of locking teeth, a hub formed with a screw socket and a pair of radially extending rotation preventing members enclosing between them a lead receiving aperture within the turret. A clamping screw can be manually adjusted between a locking position clamping the mounting plate immovably to the elbow by locking engagement of respective teeth and a release position permitting vertical rotation of the lamp housing limited by engagement of the rotation limiting rib and rotation preventing members.

8 Claims, 4 Drawing Sheets

AIMING DEVICE FOR TRACK LIGHTING

FIELD OF THE INVENTION

The invention relates to an aiming device for track lighting.

BACKGROUND OF THE INVENTION

Numerous aiming devices for adjustably mounting lamps on, usually, overhead tracks have been proposed. for example as shown in Frequently, in conventional track lighting fixtures, the lamp housings assemblies or luminaires are mounted for rotation in a horizontal plane on the lower ends of extension tubes depending from ballast/transformer boxes attached at desired locations to the tracks. A trunnion type swivel mounting bracket or trapeze assembly mounts the lamp housing to the extension tube to permit rotation thereof in a vertical plane. However, such assembly often extends downward for a distance which is undsirably large when it is desired to mount the power supplying tracks and fittings in areas of low clearance. A lateral or side arm mount for the lamp housing assembly is then desirable.

However, such assemblies have often been of undesirable complex construction requiring many different members which must be manufactured by expensive machining and are time consuming to assemble. In addition, to avoid risk of excessive rotation causing damage to a lead connected to the lamp (with consequential risk of a short circuit) it is often desired to provide members limiting the rotation of the lamp assembly. At the same time, for reasons of both safety and esthetics, it is desirable that the lead be completely concealed from view and protected within the assembly.

In two prior assemblies, for example taught by U.S. Pat. No. 5,325,281, issued Jun. 28, 1994 to Harwood and U.S. Pat. No. 4,931,917 issued Jun. 5, 1990 to Scherf et al, lamp housings are rotatively mounted on arms which extend laterally (horizontally) from lower ends of the extension tubes. In the first, where the lead is completely concealed, the assembly comprises numerous different members requiring the lead to be threaded therethrough and the adjustment of several nuts, while the rotation limiting members are located on a remotely located arm which would undesirable increase the overall size and applied cost of the assembly. The second document teaches a different approach utilizing a trapeze in which a portion of the lead by passes the rotation limiting members resulting in a relatively large and expensive structure with the lead exposed to view and risk of damage.

Various examples of other lighting arrangements are disclosed in U.S. Pat. No. 3,543,017 issued to Mihailoff in 1970; U.S. Pat. No. 5,049,081 issued in 1991 to Ribitsch et al; U.S. Pat. No. 4,814,955 issued 1989 to Price and U.S. Pat. No. 4,727,460 issued 1988 to Payne. However, none of these provide a satisfactory solution.

SUMMARY OF THE INVENTION

It is an object of the invention to provide an aiming device for track lighting which is of low profile for fitting in areas of low clearance.

It is another object of the invention to provide an aiming device for track lighting which requires relatively few separate parts and is relatively easy to assemble with the lead and to adjust.

It is an additional object of the invention to provide an aiming device for track lighting which provides complete concealment of the lead without risk of abrasion during rotary adjustment in a relatively compact assembly. According to one aspect of the invention, there is provided an aiming device for track lighting comprising an extension tube having an upper end for attachment to a track lighting fixture; an elbow member having an upper end portion rotatively mounted on the lower end of the extension tube for rotation of the elbow about an extension tube axis and a transverse lower end portion having a rim formed with a ring of looking teeth and a rotation limiting stop adjacent the rim; a lamp housing having a transverse sidewall formed with an annular turret-form mounting portion having a hub with a central screw receiving socket, a lead receiving through-aperture within the turret, and a rim formed with a ring of locking teeth matching the locking teeth of the elbow and a rotation limiting member adjacent the rim; locking screw means extending axially through the transverse lower end portion of the elbow and into the screw receiving socket to assembly the lamp assembly to the lower end of the elbow with the lead extending from the track lighting fixture through the extension tube and elbow and into the lamp housing through the through-aperture in the mounting plate, and with the rotation limiting stop and rotation limiting member on common rotational paths, the screw means being manually adjustable between a locking position in which the teeth on the elbow and the mounting plate are moved axially together into meshed, rotation preventing engagement, and a rotation permitting position in which the lamp housing can be manually rotated in a vertical plane, such rotation being limited by abutment of the rotation limiting member on the lower end portion of the elbow and the rotation limiting stop on the mounting plate.

Preferably, the rotation limiting member protrudes out beyond the rim of the turret-form mounting portion into the lower end portion of the elbow providing a positive mating relationship.

In one example, the rotation limiting member comprises a pair of elements extending radially from the hub to subtend a predetermined angle of rotation and defining between them, on one diametrical side, the lead admitting through-aperture and having respective surfaces on an opposite diametrical side engageable with respective opposite sides of the rotation limiting stop on the elbow in respective extreme opposite positions of rotation thereby to limit the rotation of the lamp housing. The rotation limiting stop comprises an a rib on an internal surface of the lower end portion of the elbow.

BRIEF DESCRIPTION OF THE DRAWINGS

An embodiment of the invention will now be described by way of example only and with reference to the accompanying drawings in which.

DESCRIPTION OF PARTICULAR EMBODIMENT

Figure 1:
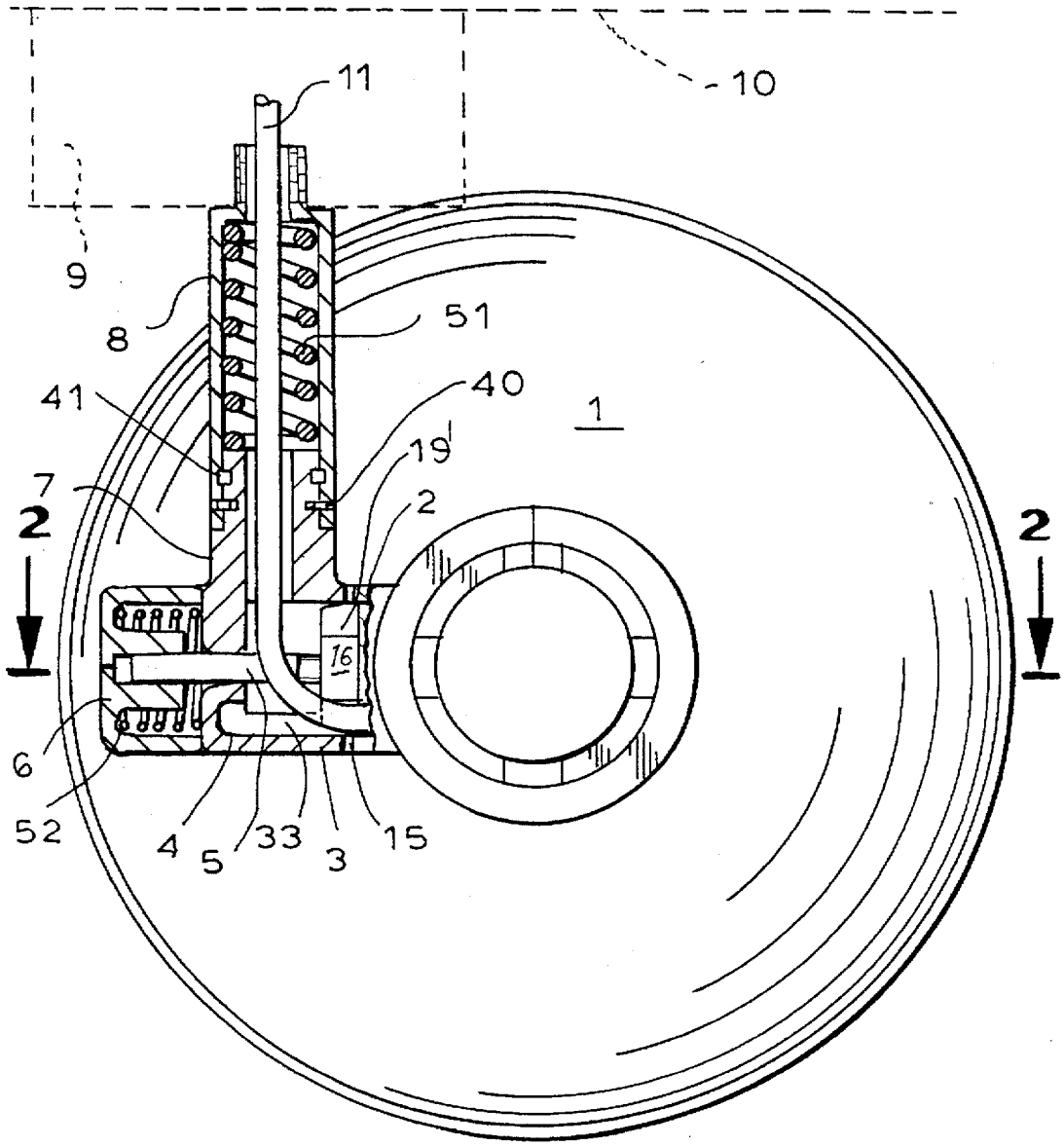
FIG. 1 is a rear elevational view of the aiming device and lampholder shown partly in cross-section.
Figure 2:
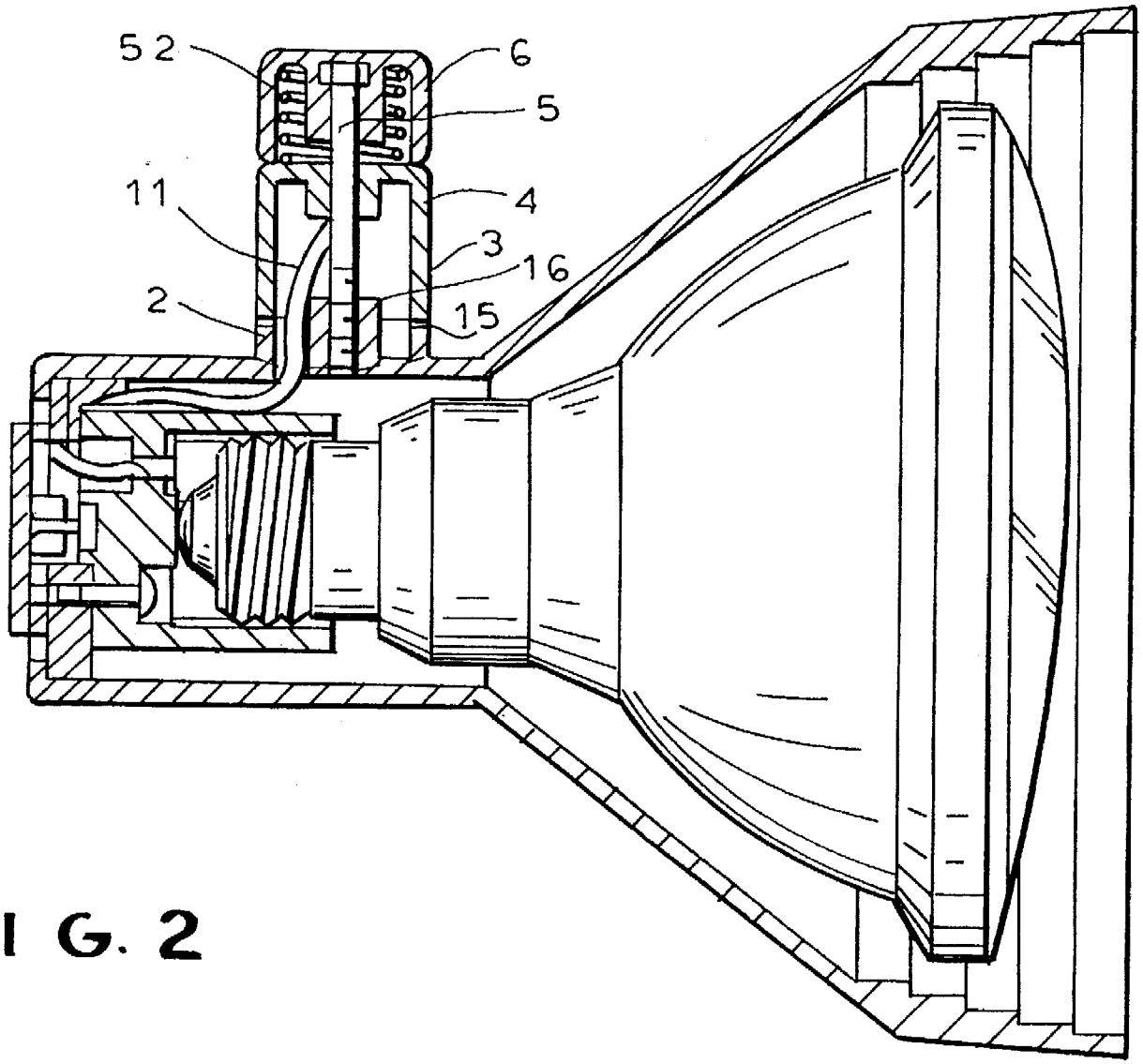
FIG. 2 is a cross-sectional view of the aiming device and lampholder taken in a horizontal plane along lines 2—2 of FIG. 1.

In brief, as shown in FIG. 1, the aiming device comprises a lampholder 1 having a mounting plate integrally formed with one side and adjustably attached for rotation in the vertical plane between angles of 90 and 270 degrees (180 degree rotation) to a short, lower horizontal arm 3 of a hollow elbow member 4 by a clamping screw 5 carried by a manually adjustable knob 6. A vertical, longer arm 7 of the elbow 4 being connected at an upper end for rotation through 355 degrees in a horizontal plane in a known manner to a lower end of extension tube 8 having an upper end for attachment to a ballast/transformer housing mounted on a power supplying track 10. A power lead 11 extends from the ballast or transformer housing 9 down the interior of the extension tube 8 and through the elbow 4 via the mounting plate 2 into the lampholder housing, completely concealed and protected at all times and in all positions of adjustment of the lampholder.

Figure 6B:
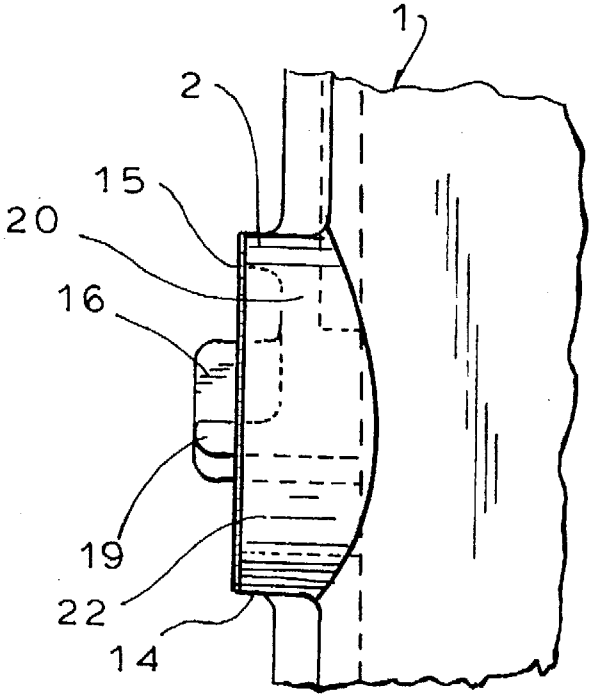
Figure 6A:
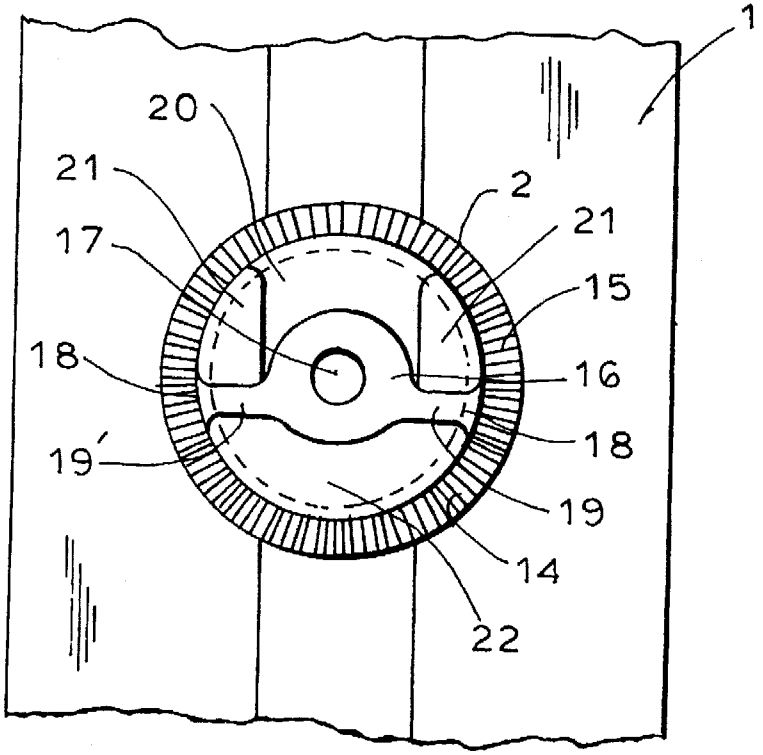

As shown more particularly in FIGS. 6A and 6B, the mounting plate 2 is cast integrally with the lamp housing 1 and comprises a laterally projecting, hollow, cylindrical turret 14 having a rim formed with an annulus of locking teeth 15, a hub portion 16 formed with a threaded socket for receipt of screw 6 and which protrudes axially beyond the turret rim and is joined to respective opposite diametrical inside wall portions of the turret by radially extending axially offset spokes 18. The spokes have stop portions of reduced radial length which also protrude axially beyond the turret rim. A web 20 connects an upper portion of the hub to the main body portion of the lamp housing leaving apertures 21 at respective opposite sides of the web and a generally semicircular, lead receiving through aperture 22 below the spokes 18 and below the rotation limiting members 19.

Figure 3C:
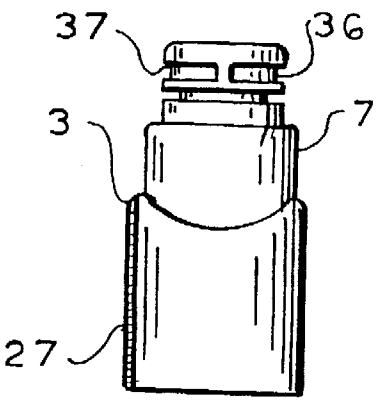
FIGS. 3A, 3B and 3C are, respectively, a cross-sectional view taken along line 3A—3A of FIG. 3B, and orthogonal (side and front) elevation at views of an elbow member of the aiming device.
Figure 3B:
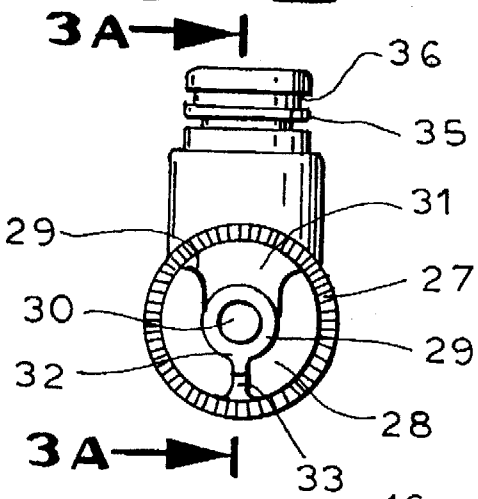
Figure 3A:
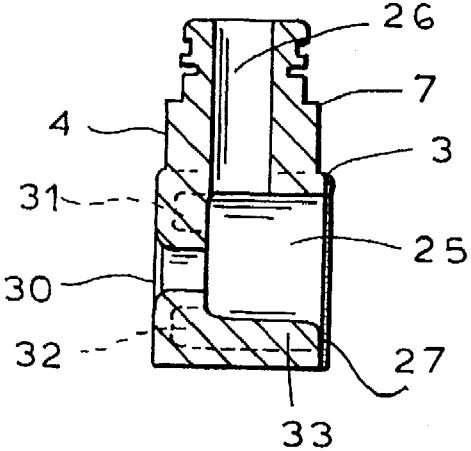

As shown particularly in FIGS. 3A–3C, the hollow elbow member 4 comprises a short, lower arm 3 extending orthogonally from a long, upper vertical arm 7 providing lower and upper, lead receiving counterbores 25 and 26. A free end of the elbow has a rim formed with an annulus of locking teeth 27 matched with those of the mounting plate and surrounding the counterbore 25. An opposite end of the elbow 4 is closed and formed centrally with a sleeve form, screw receiving through socket 29 integrally joined to upper and lower wall portions by broad and narrow radially extending lands 31 and 32, respectively. A rotational limiting stop rib 33 extends axially along a lower inside wall surface between the land 32 and the toothed rim 27. An upper end of the arm 7 is formed with annular locating grooves 35 and 36 for receipt of a circlip and stop ball, 40 and 41, respectively, (FIG. 1), the upper groove 36 being bridged by a rotation limiting wall 37 to rotatively attach the elbow to the lower end of the extension tube in known manner.

Figure 4C:
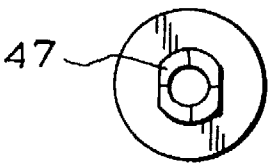
FIGS. 4A, 4B and 4C are, respectively, a lower end view, axial cross-sectional view and upper end view of a vertically extending tube or stem member of the aiming device.
Figure 4B:
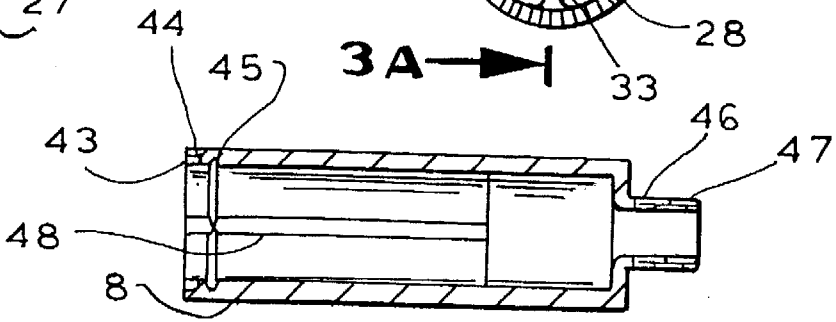
Figure 5:
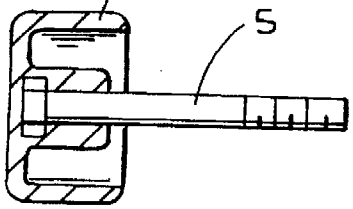
FIG. 5 is a partly cross-sectional view of a locking knob of the aiming device; and, FIGS. 6A and 6B are, respectively, rear and side views of a mounting plate of the lamp holder of the aiming device.
Figure 4A:
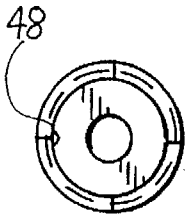

As shown particularly in FIGS. 4A, 4B and 4C, the sleeve-form extension tube 8, is constructed according to the prior art, and comprises a large lower end with internal circumferential grooves 44 and 45 for cooperation with grooves 35 and 36 for receipt of the locking circlip and ball 40 and 41 to rotatively mount the elbow thereto in known manner, and a necked upper end 46 formed with an external thread 47.

In the assembled aiming device, the upper end portion of the longer arm 7 of the elbow is trapped in the lower end of the extension tube 8, cut to length, by the circlip or washer 41 received in opposed grooves 35 and 44 permitting rotation of the elbow in the horizontal plane which rotation is limited to 355 degrees by the ball becoming trapped between the bridge 37 and the rib 48. An helical compression spring trapped between a shoulder formed by the necked end 46 and the upper end of the elbow arm 7 provides sufficient clamping force to maintain the elbow and lamp housing carried thereby in any desired rotational position.

The lamp housing 1 is clamped to the elbow 4 by the locking screw 5 passing through the socket 30 in the elbow into threaded engagement with the socket 17 in the mounting plate 2 bringing the teeth 15 and 27 into engagement. When so assembled, the hub 16 and rotation limiting members 19 protrude into the open end of the elbow so that the rotation limiting rib lies in their rotational path. In the position of adjustment shown in FIG. 1 in which the lamp axis is horizontal (at 90 degrees), the rotation limiting rib 33 of the elbow 4 protrudes in front of the rotation preventing member 19 of the mounting plate, and the lead 11 passes through the aperture 22.

Thus, rotation of the lamp housing in the vertical plane from a 90 degree position shown in FIG. 1, to swivel the front of the lamp through 180 degrees down and back to face the reader to a 270 degree position, (clockwise rotation when viewed from the right side of the figure), will rotate the rotation limiting members through 180 degrees bringing the upper member 19 into abutment with a front side of the rib 33, preventing further rotation in the same direction. The lead 11 remains trapped throughout such movement by the rotation limiting members 19 and ribs 18 for rotation with the lamp housing preventing any undesirable twisting and possibly abrading or otherwise damaging engagement with the rib 33 or other non-rotating member.

Subsequent rotation in the opposite direct is similarly limited to 180 degrees by abutment of the other rotation limiting member 19 and the back face of the rib 33 (as shown in FIG. 1. The biasing force provided by the compression spring 52 trapped on the screw 5 between the knob 6 and the blind end of the lower arm 3 of the elbow can be manually adjusted by the knob to permit the teeth 15 and 27 to be brought into and out from locking engagement to prevent and permit the rotation.

Thus, the elbow permits ease of wiring and assembly with the teeth assuring secure locking and distributing the load on the mounting plate with the spring thereof assuring desired constant biassing force on the mounting plate. The spring 51 assures proper positioning both with ceiling and wall applications. The side mounting arrangement enabled by the elbow allows the lamp assembly to be mounted closer to the track without hindering the ability to position the fixture providing a desirably low profile structure allowing the track and its variety of heads to be mounted in low clearance areas. The internal locations of the rotation limiting members and rib enabling an aesthetically pleasing smooth outer profile to be obtained.

The mounting plate and main body portion of the lamp housing can be manufactured economically as one piece by a simple metal casting technique. the design of the elbow also permits easy manufacture as a metal casting.

I claim:

1. An aiming device for track lighting comprising:

an extension tube having an upper end for attachment to a track lighting fixture;

an elbow member having an upper end portion rotatively mounted on a lower end of the extension tube for rotation of the elbow about an extension tube axis and a transverse lower end portion having a rim formed with a ring of locking teeth and a rotation limiting stop adjacent the rim;

a lamp housing having a transverse sidewall formed with an annular mounting portion with a central screw receiving socket, a lead receiving through-aperture, a second rim formed with a ring of locking teeth matching the locking teeth of the elbow, the through aperture extending through the mounting portion, and a rotation limiting member adjacent the second rim;

locking screw means extending axially through the transverse lower end portion of the elbow and into the screw receiving socket to assemble the lamp assembly to the lower end portion of the elbow with a lead extending from the track lighting fixture through the extension tube and elbow and into the lamp housing through the through-aperture in the mounting portion, and with the rotation limiting stop and rotation limiting member on common rotational paths, the screw means being manually adjustable between a locking position in which the teeth on the elbow and the mounting portion are moved axially together into meshed, rotation preventing engagement, and a rotation permitting position in which the lamp housing can be manually rotated in a vertical plane, such rotation being limited by abutment of the rotation limiting stop on the lower end portion of the elbow and the rotation limiting member on the mounting portion.

2. An aiming device for track lighting comprising:

an extension tube having an upper end for attachment to a track lighting fixture;

an elbow member having an upper end portion rotatively mounted on a lower end of the extension tube for rotation of the elbow about an extension tube axis and a transverse lower end portion having a rim formed with a ring of locking teeth and a rotation limiting stop adjacent the rim;

a lamp housing having a transverse sidewall formed with an annular turret-form mounting portion having a hub with a central screw receiving socket, a lead receiving through-aperture within the turret, and a second rim mounting portion formed with a ring of locking teeth matching the locking teeth of the elbow, the through-aperture extending through the mounting portion, and a rotation limiting member adjacent the second rim;

locking screw means extending axially through the transverse lower end portion of the elbow and into the screw receiving socket to assemble the lamp assembly to the lower end portion of the elbow with a lead extending from the track lighting fixture through the extension tube and elbow and into the lamp housing through the through-aperture in the mounting portion, and with the rotation limiting stop and rotation limiting member on common rotational paths, the screw means being manually adjustable between a locking position in which the teeth on the elbow and the mounting portion are moved axially together into meshed, rotation preventing engagement, and a rotation permitting position in which the lamp housing can be manually rotated in a vertical plane, such rotation being limited by abutment of the rotation limiting stop on the lower end portion of the elbow and the rotation limiting member on the mounting portion.

3. An aiming device according to claim 2 wherein the rotation limiting member protrudes out beyond the second rim into the lower end portion of the elbow.

4. An aiming device according to claim 3 wherein the rotation limiting member comprises a pair of radially extending elements subtending a predetermined angle of rotation and enclosing between said elements on one diametrical side the lead admitting through-aperture and having respective surfaces on an opposite diametrical side engageable with respective opposite sides of the rotation limiting stop on the elbow in respective extreme opposite positions of rotation thereby to limit the rotation of the lamp housing.

5. An aiming device according to claim 3 wherein the rotation limiting stop comprises an a rib on an internal surface of the lower end portion of the elbow.

6. An aiming device according to claim 2 wherein the rotation limiting member comprises a pair of radially extending elements subtending a predetermined angle of rotation and enclosing between said elements, on one diametrical side, the lead admitting through-aperture, and having respective surfaces on an opposite diametrical side engageable with respective opposite sides of the rotation limiting stop on the elbow in respective extreme opposite positions of rotation thereby to limit the rotation of the lamp housing.

7. An aiming device according to claim 2 wherein the rotation limiting members extend radially from the hub.

8. An aiming device according to claim 7 wherein the rotation limiting members subtend an angle of substantially 180 degrees.

* * * * *